US011746665B2

(12) United States Patent
Stoyanov et al.

(10) Patent No.: US 11,746,665 B2
(45) Date of Patent: Sep. 5, 2023

(54) BUSHING FOR VARIABLE VANE IN A GAS TURBINE ENGINE

(71) Applicant: Raytheon Technologies Corporation, Farmington, CT (US)

(72) Inventors: Pantcho P. Stoyanov, West Hartford, CT (US); Mary E. Makowiec, Manchester, CT (US)

(73) Assignee: RTX Corporation, Farmington, CT (US)

( * ) Notice: Subject to any disclaimer, the term of this patent is extended or adjusted under 35 U.S.C. 154(b) by 0 days.

(21) Appl. No.: 17/827,235

(22) Filed: May 27, 2022

(65) Prior Publication Data

US 2022/0282629 A1 Sep. 8, 2022

Related U.S. Application Data

(62) Division of application No. 16/431,334, filed on Jun. 4, 2019, now Pat. No. 11,346,235.

(51) Int. Cl.
*F01D 9/04* (2006.01)
*F01D 17/16* (2006.01)

(52) U.S. Cl.
CPC ..... *F01D 9/041* (2013.01); *F01D 9/042* (2013.01); *F01D 17/162* (2013.01); *F05D 2220/32* (2013.01); *F05D 2240/12* (2013.01)

(58) Field of Classification Search
CPC ..... F01D 9/041; F01D 9/042; F01D 17/162; F16C 33/10; F16C 33/1095; F16C 33/14; F16C 33/16; F16C 17/02; F16C 2223/02; F16C 2231/00; F16C 2326/43; F16C 2360/23
See application file for complete search history.

(56) References Cited

U.S. PATENT DOCUMENTS

| | | | | |
|---|---|---|---|---|
| 2,086,787 | A | 7/1937 | Whiteley | |
| 7,163,369 | B2 | 1/2007 | Bruce | |
| 7,220,098 | B2 | 5/2007 | Bruce et al. | |
| 7,318,847 | B2 * | 1/2008 | Massler | F16C 33/1075 427/249.7 |
| 7,360,990 | B2 | 4/2008 | Barbe | |

(Continued)

FOREIGN PATENT DOCUMENTS

| | | | | |
|---|---|---|---|---|
| DE | 101013212488 | A1 * | 12/2014 | F16C 33/121 |
| DE | 102013212488 | A | 12/2014 | |

(Continued)

OTHER PUBLICATIONS

EP Extended Search Report for EP Application No. 20177667.1 dated Aug. 20, 2020.

*Primary Examiner* — Brian P Wolcott

(74) *Attorney, Agent, or Firm* — Carlson, Gaskey & Olds, P.C.

(57) ABSTRACT

A method of operating a variable vane for a gas turbine includes the step of locating a first bushing at least partially surrounding a first trunnion that extends from a first end of the variable vane. The first trunnion includes an outer surface that has a plurality of troughs. The first bushing includes a plurality of peaks that extend inward from an inner surface. Relative movement is produced between the first bushing and the first trunnion to form a carbon transfer film between the first bushing and the first trunnion.

20 Claims, 7 Drawing Sheets

(56) References Cited

U.S. PATENT DOCUMENTS

| | | | | |
|---|---|---|---|---|
| 7,510,369 | B2 | 3/2009 | Lytle | |
| 9,353,643 | B2 * | 5/2016 | Major | F01D 17/162 |
| 9,410,443 | B2 | 8/2016 | Dube | |
| 2006/0110246 | A1 | 5/2006 | Bruce | |
| 2007/0160464 | A1 | 7/2007 | Lesnevsky et al. | |
| 2020/0132111 | A1 * | 4/2020 | Diew | F16C 9/04 |

FOREIGN PATENT DOCUMENTS

| | | | | |
|---|---|---|---|---|
| EP | 1524413 | | 4/2005 | |
| EP | 1524413 | A2 * | 4/2005 | F01D 17/162 |
| WO | 3091474 | A | 11/2003 | |
| WO | 2019008265 | A | 1/2019 | |

* cited by examiner

BUSHING FOR VARIABLE VANE IN A GAS TURBINE ENGINE

CROSS-REFERENCE TO RELATED APPLICATIONS

This disclosure is a divisional of U.S. patent application Ser. No. 16/431,334 filed Jun. 4, 2019.

BACKGROUND

This disclosure relates generally to a variable vane and, more particularly, to a bushing for the variable vane.

Turbomachines, such as gas turbine engines, typically include a fan section, a compressor section, a combustor section, and a turbine section. Air moves into the turbomachine through the fan section. Airfoil arrays in the compressor section rotate to compress the air, which is then mixed with fuel and combusted in the combustor section. The products of combustion are expanded to rotatably drive airfoil arrays in the turbine section. Rotating the airfoil arrays in the turbine section drives rotation of the fan and compressor sections.

Some turbomachines include variable vanes. Changing the positions of the variable vanes influences how flow moves through the turbomachine. Variable vanes are often used within the first few stages of the compressor section. The variable vanes are also exposed to vibrations during operation of the turbomachine.

SUMMARY

In one exemplary embodiment, a component for a gas turbine engine includes an airfoil. A first trunnion has an outer surface and extends from a first end of the airfoil. A first bushing at least partially surrounds the outer surface. At least one of the first bushing or the first trunnion includes a plurality of surface irregularities.

In a further embodiment of the above, the first trunnion is cylindrical and the plurality of surface irregularities include troughs formed in the outer surface of the first trunnion.

In a further embodiment of any of the above, the first bushing includes a plurality of surface irregularities on an inner facing surface.

In a further embodiment of any of the above, the plurality of surface irregularities include peaks extending inward from the inner facing surface of the first bushing.

In a further embodiment of any of the above, the plurality of surface irregularities include peaks extending inward from an inward facing surface of the first bushing.

In a further embodiment of any of the above, a second trunnion has an outer surface located on an opposite end of the airfoil from the first trunnion. A second bushing at least partially surrounds the outer surface on the second trunnion. At least one of the second bushing or the second trunnion includes a second plurality of surface irregularities.

In a further embodiment of any of the above, the second plurality of surface irregularities includes a plurality of troughs formed in the outer surface of the second trunnion.

In a further embodiment of any of the above, the second plurality of surface irregularities includes peaks on an inner facing surface of the second bushing.

In another exemplary embodiment, a gas turbine engine includes an outer engine structure. An inner engine structure is located radially inward from the outer engine structure. A variable vane is located between the outer engine structure and the inner engine structure and includes an airfoil. A first trunnion has an outer surface and extends from a first end of the airfoil. A first bushing at least partially surrounds the outer surface and is fixed from movement relative to the outer engine structure. At least one of the first bushing or the first trunnion includes a plurality of surface irregularities.

In a further embodiment of any of the above, the first trunnion is cylindrical and the plurality of surface irregularities include troughs formed in the outer surface of the first trunnion.

In a further embodiment of any of the above, the first bushing includes a plurality of surface irregularities on an inner facing surface.

In a further embodiment of any of the above, the plurality of surface irregularities include peaks extending inward from an inward facing surface of the first bushing.

In a further embodiment of any of the above, the plurality of surface irregularities include peaks that extend inward from an inner facing surface of the first bushing.

In a further embodiment of any of the above, a second trunnion has an outer surface located on an opposite end of the airfoil from the first trunnion. A second bushing at least partially surrounds the outer surface on the second trunnion. At least one of the second bushing or the second trunnion includes a second plurality of surface irregularities.

In a further embodiment of any of the above, the second plurality of surface irregularities include a plurality of troughs formed in the outer surface of the second trunnion.

In a further embodiment of any of the above, the second plurality of surface irregularities include peaks on an inner facing surface of the second bushing.

In another exemplary embodiment, a method of operating a variable vane for a gas turbine engine includes the step of locating a first bushing adjacent a first trunnion on a variable vane. At least one of the first bushing or the first trunnion include a first plurality of surface irregularities. Relative movement are produced between the first bushing and the first trunnion to form a carbon transfer film between the first bushing and the first trunnion.

In a further embodiment of any of the above, the first trunnion is cylindrical. The plurality of surface irregularities include troughs formed in the outer surface of the first trunnion.

In a further embodiment of any of the above, the first bushing includes a plurality of surface irregularities on an inner facing surface.

In a further embodiment of any of the above, the plurality of surface irregularities include peaks that extend inward from the inner facing surface of the first bushing.

DETAILED DESCRIPTION

Figure 1:
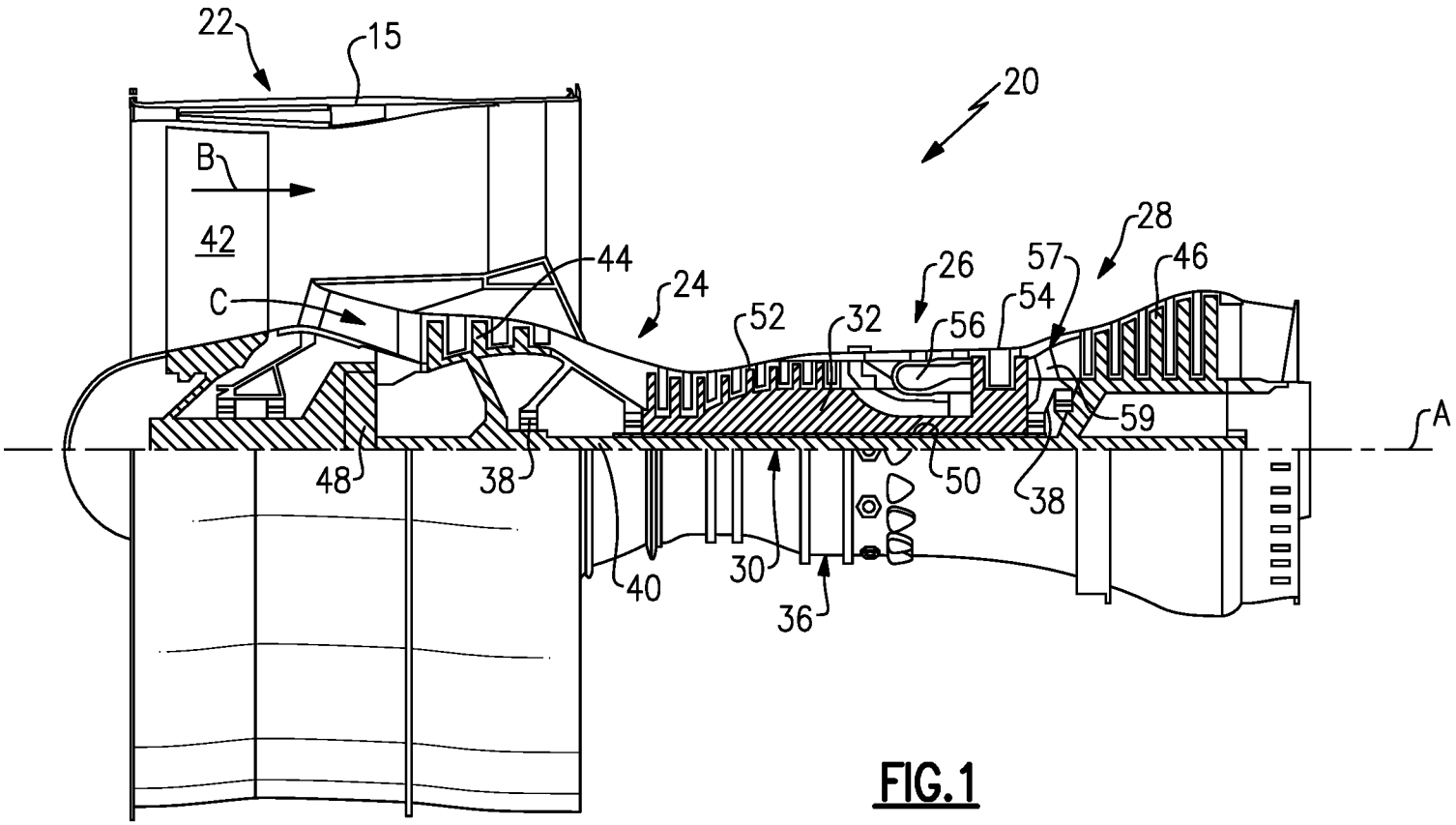
FIG. 1 is a schematic view of an example gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 drives air along a bypass flow path B in a bypass duct defined within a housing 15, such as a fan case or nacelle, and also drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive a fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 may be arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of the low pressure compressor, or aft of the combustor section 26 or even aft of turbine section 28, and fan 42 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1 and less than about 5:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second (350.5 meters/second).

Figure 2:
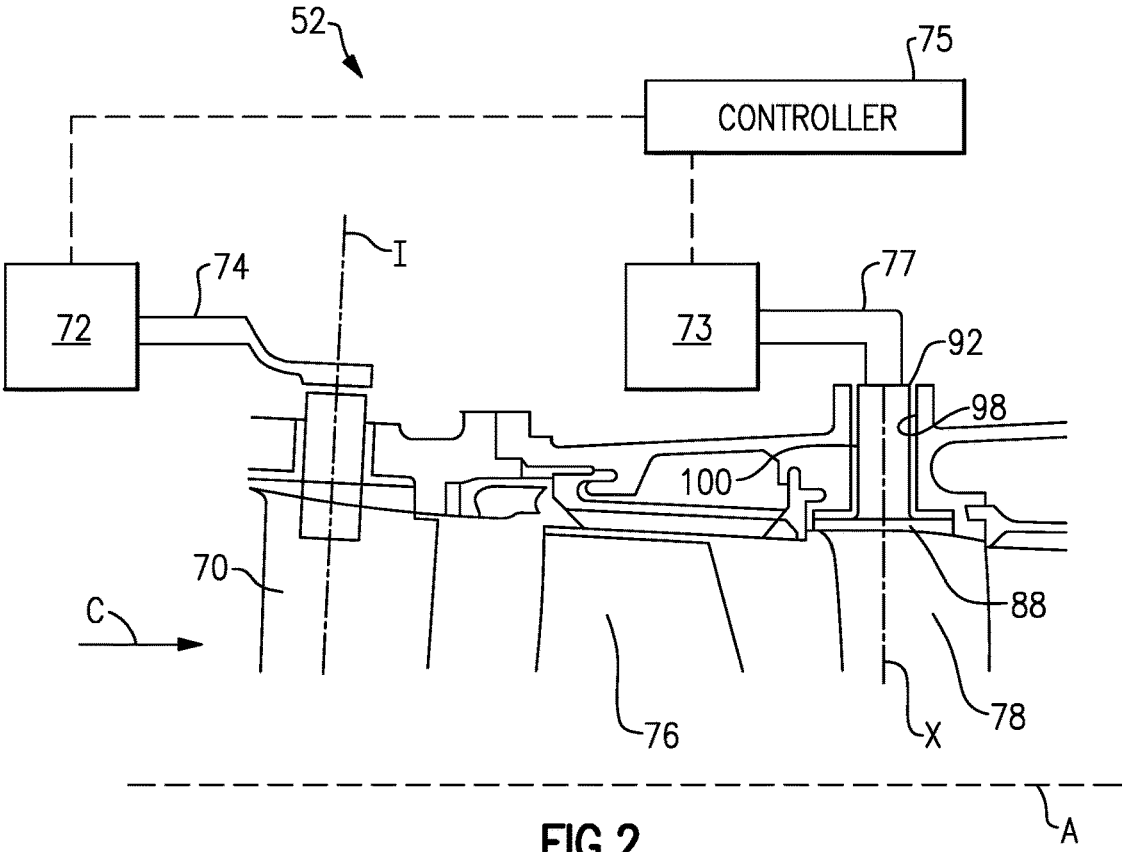
FIG. 2 illustrates a portion of an example compressor section.

FIG. 2 illustrates a portion of the high pressure compressor 52. However, other compressor sections, such as the low pressure compressor 44, can benefit from this disclosure. The high pressure compressor 52 includes inlet guide vanes 70 that are rotatable about an axis I and form a circumferential array around the engine axis A. Each of the inlet guide vanes 70 are attached to an actuator 72 through a lever arm 74. In the illustrated example, the actuator 72 includes a drive mechanism in communication with a controller 75 programmed to rotate the lever arms 74 in response to an operating condition of the gas turbine engine 20.

A plurality of rotor blades 76 are located axially downstream of the inlet guide vanes 70 and form a circumferential array around the engine axis A. Because FIG. 2 illustrates a portion of the high pressure compressor 52, the rotor blades 76 are configured to rotate with the outer shaft 50 (FIG. 1). In this disclosure, axial or axially and radial or radially is in relation to the engine axis A unless stated otherwise.

Immediately axially downstream of the rotor blades 76 are a plurality of variable vanes 78 forming a circumferential array around the engine axis A. The variable vanes 78 rotate about axis X which is generally perpendicular to the engine axis A to change a pitch of the variable vanes 78. The variable vanes 78 are connected to an actuator 73 through a lever arm 77. In the illustrated example, the actuator 72 includes a drive mechanism in communication with the controller 75 programmed to rotate the lever arms 77 in response to an operating condition of the gas turbine engine 20.

Figure 3:
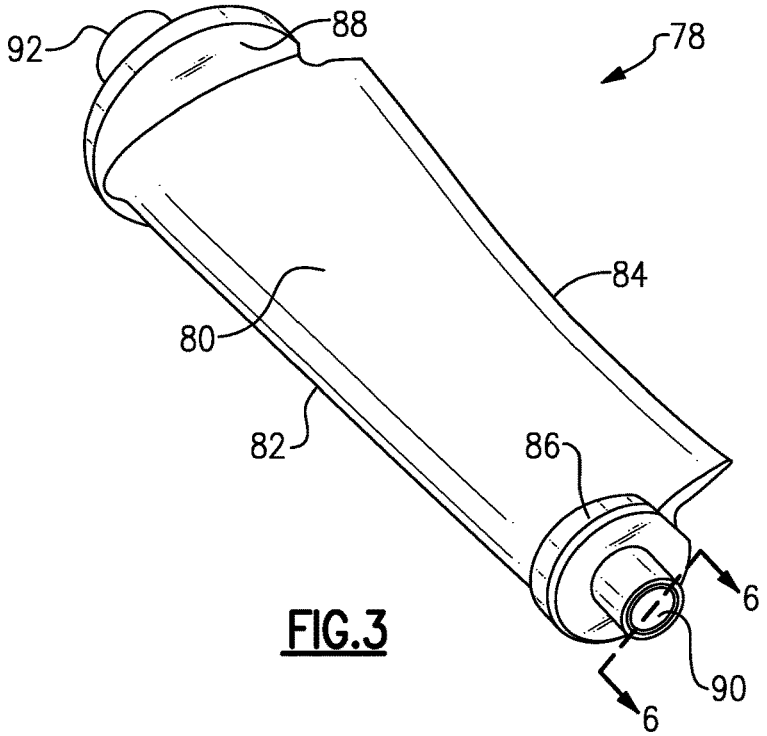
FIG. 3 illustrates an example variable vane.
Figure 4:
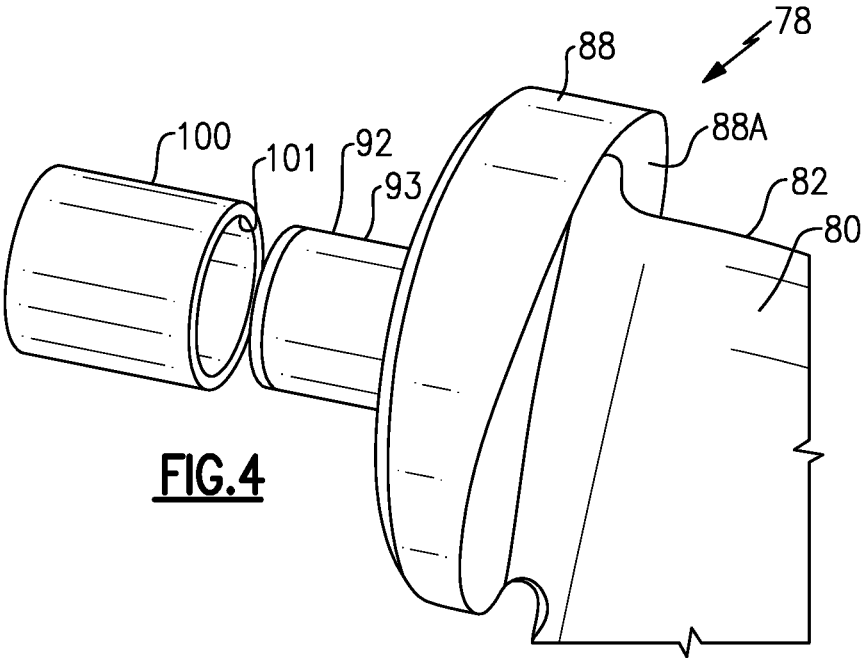
FIG. 4 illustrates a perspective view of an end portion of the example variable vane of FIG. 3.
Figure 5:
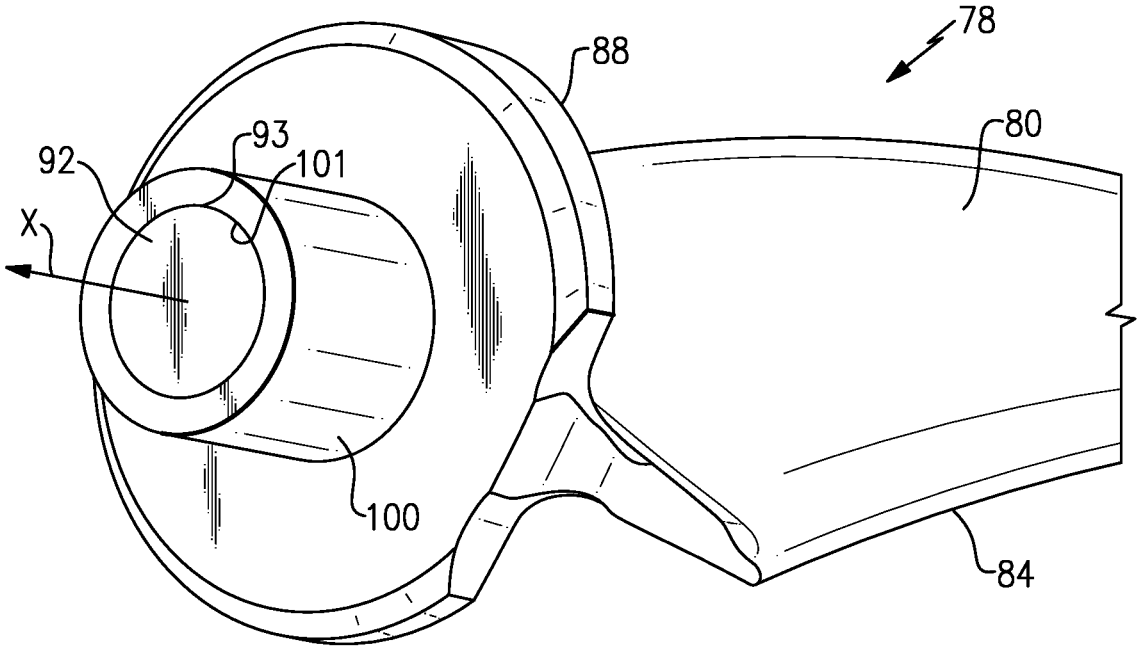
FIG. 5 illustrates another perspective view of the end portion of the example variable vane of FIG. 3.
Figure 6:
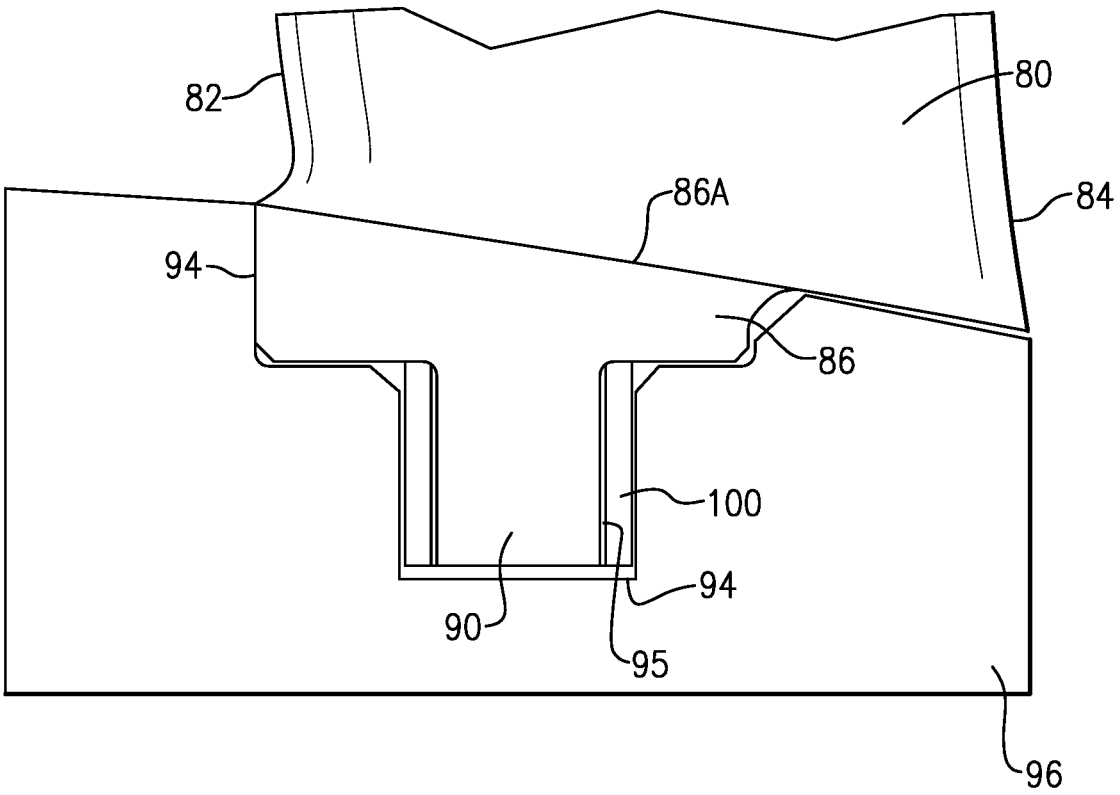
FIG. 6 is a cross-sectional view taken along line 6-6 of FIG. 3 with an inner structure.

As shown in FIG. 3, each of the variable vanes 78 include an airfoil 80 extending axially between a leading edge 82 and a trailing edge 84 and radially between a radially inner structure 86 and a radially outer structure 88. An inner trunnion 90 extends radially inward from the inner structure 86 and an outer trunnion 92 extends radially outward from the outer structure 88. In the illustrated example, the inner and outer trunnions 90, 92 are cylindrical in cross section. The inner trunnion 90 is accepted within a corresponding opening 94 (FIG. 6) in an inner structure 96 and the outer trunnion 92 is accepted within a corresponding opening 98 (FIG. 2) in a portion of the static structure 36. The openings 94, 98 also accept a respective portion of the inner and outer structure 86, 88 such that a surface 86A on the inner structure 86 (FIG. 6) and a surface 88A on the outer structure 88 (FIG. 4) at least partially define the core flowpath C.

As shown in FIGS. 2 and 4-6, the outer trunnion 92 is at least partially separated from the static structure 36 by a bushing 100 in contact with an outer surface 93 on the outer trunnion 92. Similarly, an outer surface 95 on the inner trunnion 90 is at least partially separated from the inner structure 96 by the bushing 100. In the illustrated example, the bushings 100 are made from at least one of a carbon graphite or an electrographitic carbon material.

Figure 7:
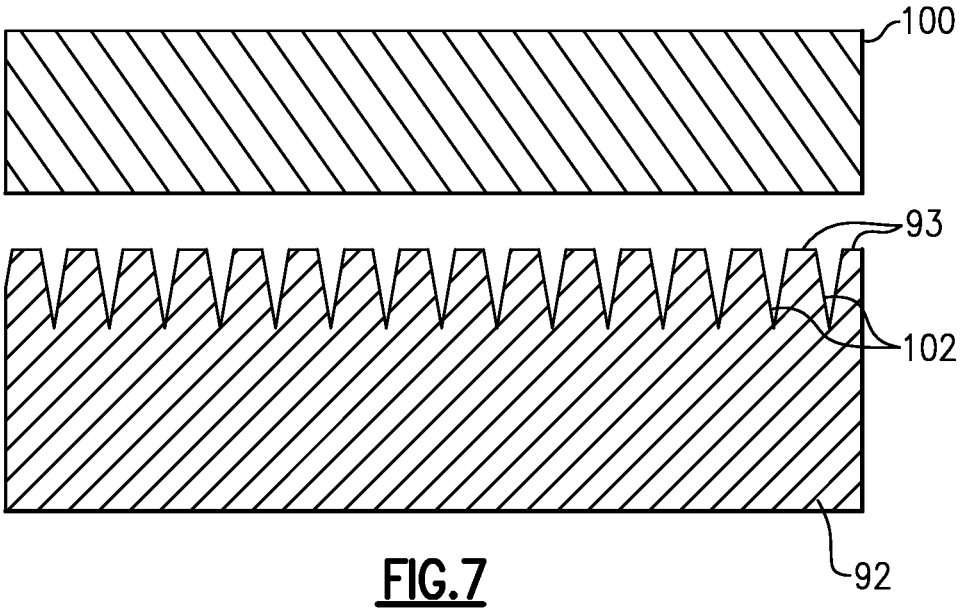
FIG. 7 illustrates an interface between a bushing and a trunnion on the example variable vane of FIG. 3 in an unworn condition.

FIG. 7 illustrates a portion of an example interface between the bushing 100 and the outer trunnion 92. Although the illustrated example is directed to the outer trunnion 92, a similar interface would occur between one of the bushings 100 and the inner trunnion 90. The interface between the bushing 100 and the trunnion 92 of FIG. 7 is in an unworn or original condition upon installing the bushing 100 onto the trunnion 92. During operation of the variable vane 78, relative motion occurs between the trunnion 92 and the bushing 100, which is fixed relative to the engine static structure 36, mating the bushing 100 relative to the trunnion 92.

During the mating period, a level of contact pressure between the trunnion 92 and the bushing 100 is high due to the troughs 102 formed in the outer surface 93 of the trunnion 92 causing abrasion with an inner surface 101 on the bushing 100. The troughs 102 create discontinuities in the outer surface 93 of trunnion 92 which decreases the contacting surface area and thereby increases the contact pressure between the trunnion 92 and the bushing 100. The troughs 102 extend in a radial direction. In the illustrated example, a depth of the troughs 102 is approximately equal to a spacing between the bushing 100 and the trunnion 92 and extend in a radial direction. However, the troughs 102 could also extend in a direction with a radial and circumferential component.

Figure 8:
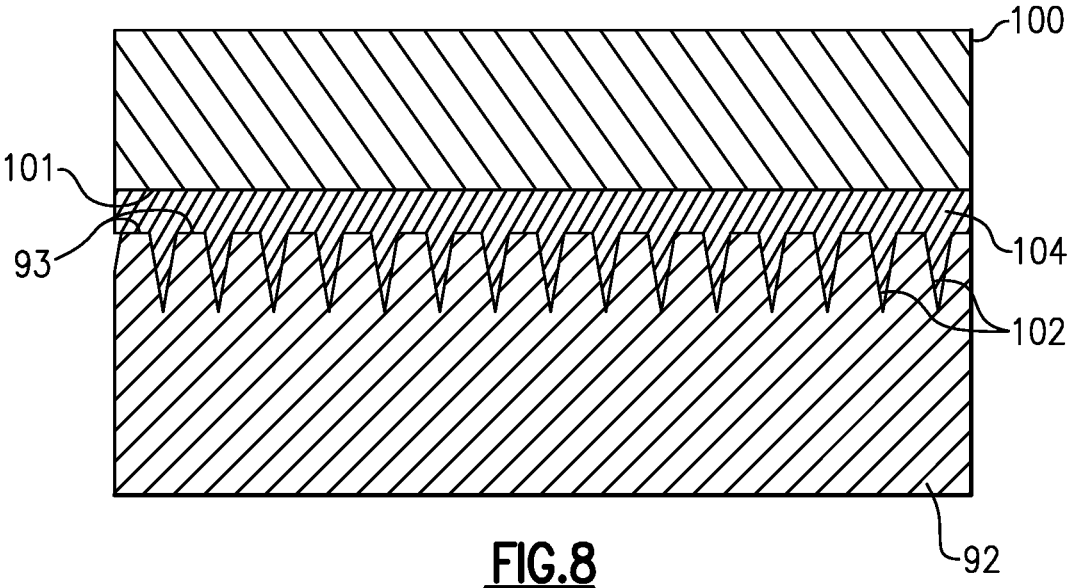
FIG. 8 illustrates the interface of FIG. 7 in a mated condition.

The increased contact pressure between the two components promotes the formation of a transfer film 104 (FIG. 8) between the bushing 100 and the trunnion 92. The transfer film 104 is carbon based and collects on the outer surface 93 of the trunnion 92 to create a carbon on carbon interface between the transfer film 104 and the bushing 100. The carbon on carbon interface results in a lower level of friction and wear between the bushing 100 and the trunnion 92 after the initial mating period between the trunnion 92 and the bushing 100 has occurred.

Figure 9:
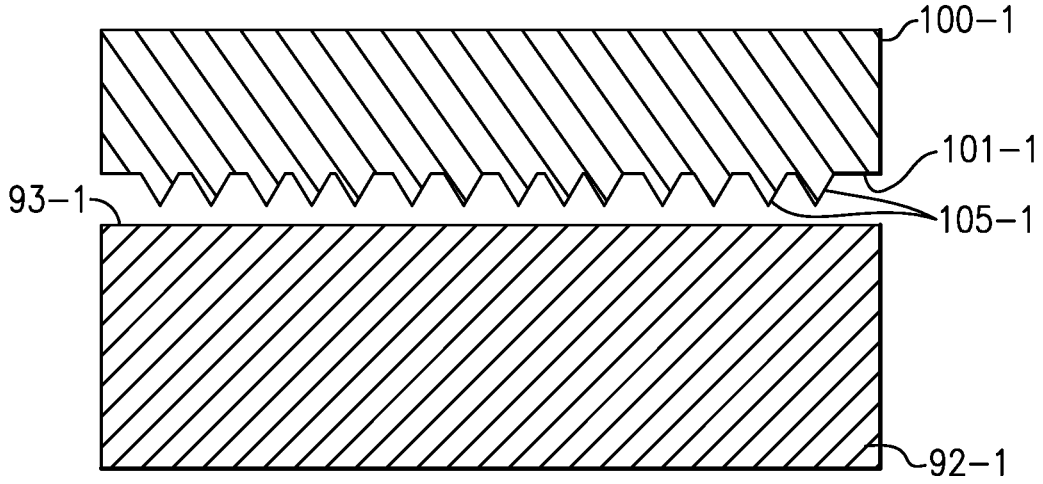
FIG. 9 illustrates another example interface between a bushing and a trunnion in an unworn condition.

FIG. 9 illustrates a portion of another example interface between a bushing 100-1 and the trunnion 92-1. The bushing 100-1 and the trunnion 92-1 are similar to the bushing 100 and trunnion 92, respectively, except where described below or shown in the Figures. An inner surface 101-1 of the bushing 100-1 includes a plurality of protrusions or peaks 105-1 that extend inward from the inner surface 101-1 towards the outer surface 93-1 on the trunnion 92. The peaks 105-1 are present during the unworn or original condition of the bushing 100.

Figure 10:
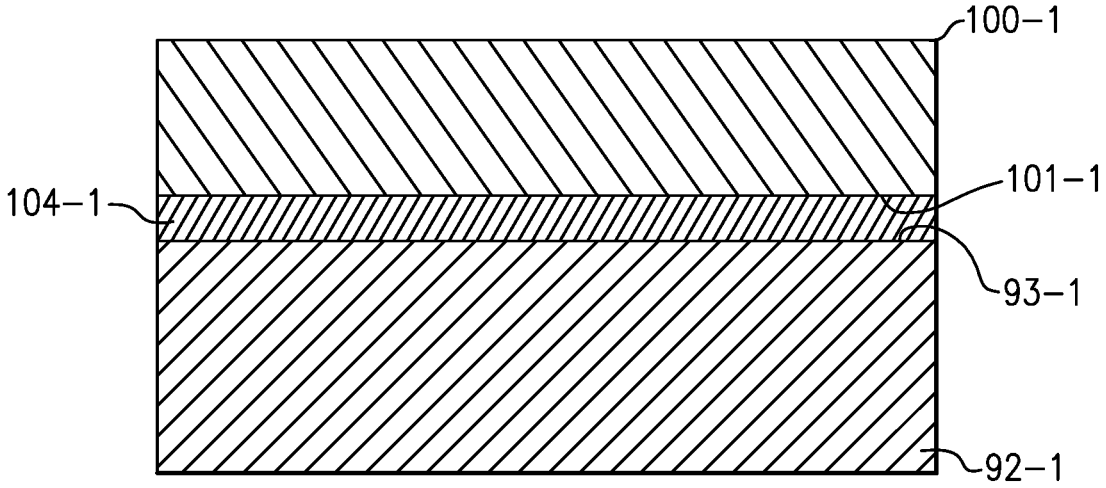
FIG. 10 illustrates the interface of FIG. 9 in a mated condition.

However, during the mating period, a level of contact pressure between the trunnion 92-1 and the bushing 100-1 is high because only the peaks 105-1 contact an outer surface 93-1 on the trunnion 92-1. The peaks 105-1 extend in a radial direction along the inner surface 101-1. When the bushing 100-1 and the trunnion 92-1 have had a sufficient period of operation for mating, the peaks 105-1 will have worn down to be approximately flush with the surface 101-1 (FIG. 10). The wearing away of the peaks 105-1 forms a transfer film 104-1 between the bushing 100-1 and the trunnion 92-1. The transfer film 104-1 is carbon based and bonds with the outer surface 93-1 of the trunnion 92-1 to create a carbon on carbon interface between the transfer film 104-1 and the bushing 100-1 which results in a lower level of friction and wear between the bushing 100-1 and the trunnion 92-1.

Figure 11:
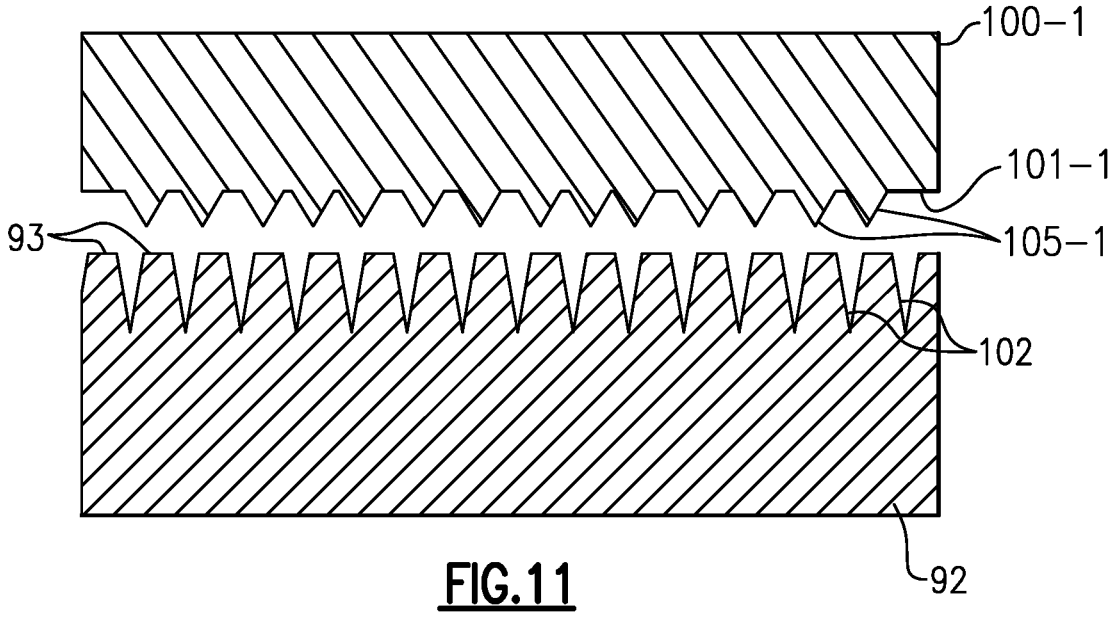
FIG. 11 illustrates yet another interface between a bushing and a trunnion in an unworn condition.
Figure 12:
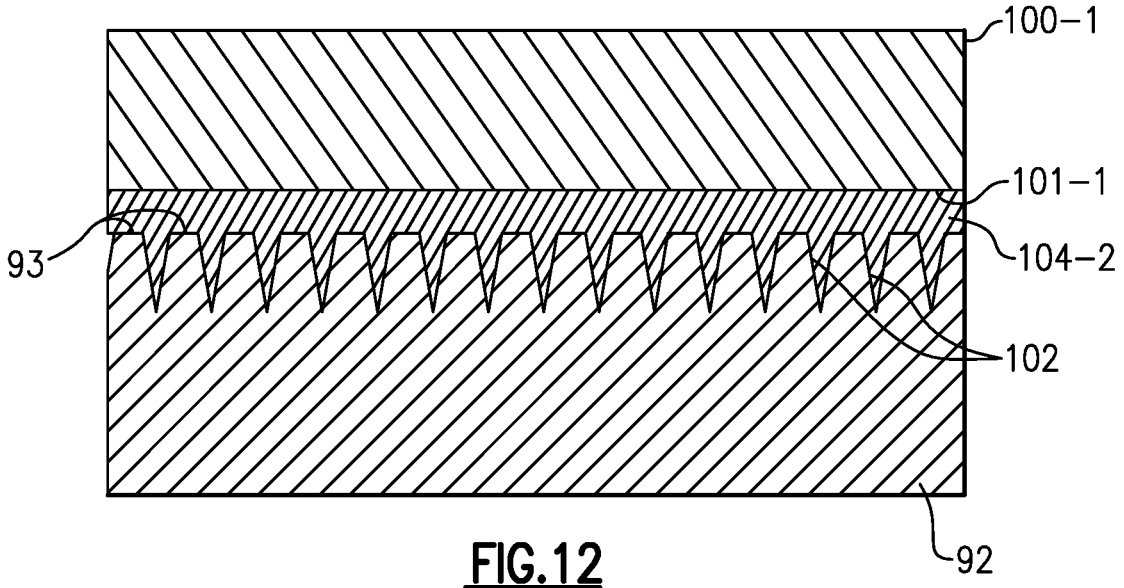
FIG. 12 illustrates the interface of FIG. 11 in a mated condition.

FIG. 11 illustrates a combination of the bushing 100-1 from FIG. 9 and the trunnion 92 from FIG. 7. The combination of the bushing 100-1 and the trunnion 92 creates the greatest amount of contact pressure during the initial mating period. The increased amount of contact pressure leads to a faster formation of the carbon transfer film 104-2 (shown in FIG. 12) between the components. As discussed above, the transfer film 104-2 creates a carbon on carbon interface between the trunnion 92 and the carbon based bushing 100-1 to reduce the amount of friction and wear during operation of the variable vane 78.

Although the different non-limiting embodiments are illustrated as having specific components, the embodiments of this disclosure are not limited to those particular combinations. It is possible to use some of the components or features from any of the non-limiting embodiments in combination with features or components from any of the other non-limiting embodiments.

It should be understood that like reference numerals identify corresponding or similar elements throughout the several drawings. It should also be understood that although a particular component arrangement is disclosed and illustrated in these exemplary embodiments, other arrangements could also benefit from the teachings of this disclosure.

The foregoing description shall be interpreted as illustrative and not in any limiting sense. A worker of ordinary skill in the art would understand that certain modifications could come within the scope of this disclosure. For these reasons, the following claim should be studied to determine the true scope and content of this disclosure.

What is claimed is:

1. A method of operating a variable vane for a gas turbine engine, the method comprising:

locating a first bushing at least partially surrounding a first trunnion extending from a first end of the variable vane, the first trunnion includes an outer surface having a plurality of troughs and the first bushing includes a plurality of peaks extending inward from an inner surface;

producing relative movement between the first bushing and the first trunnion to form a carbon transfer film between the first bushing and the first trunnion; and the relative movement between the first bushing and the first trunnion wears the plurality of peaks down to form the carbon transfer film.

2. The method of claim 1, wherein the wearing down goes to the inner surface on the first bushing.

3. The method of claim 1, wherein the first trunnion is cylindrical.

4. The method of claim 1, comprising locating a second bushing at least partially surrounding a second trunnion extending from a second end of the variable vane, the second trunnion includes an outer surface having a second plurality of troughs and the second bushing includes a second plurality of peaks extending inward from an inner surface.

5. The method of claim 4, comprising producing relative movement between the second bushing and the second trunnion to form a carbon transfer film between the second bushing and the second trunnion.

6. The method of claim 1, wherein each of the plurality of peaks form a point at a junction of a first lateral side and a second lateral side.

7. The method of claim 1, wherein the first bushing is made from carbon graphite.

8. The method of claim 1, wherein the first bushing is made entirely from an electrographitic carbon material.

9. The method of claim 8, wherein each of the plurality of peaks form a point at a junction of a first lateral side and a second lateral side.

10. The method of claim 4, wherein the second bushing is made entirely from carbon graphite.

11. The method of claim 4, wherein the second bushing is made from an electrographitic carbon material.

12. The method of claim 1, wherein the plurality of troughs extends in a radial direction and include a "V" shaped cross section.

13. The method of claim 4, wherein the second plurality of troughs extends in a radial direction and include a "V" shaped cross section.

14. The method of claim 4, wherein the second trunnion is cylindrical.

15. The method of claim 4, wherein a depth of each of the second plurality of troughs is substantially equal to a spacing between the second bushing and the second trunnion.

16. A method of operating a variable vane for a gas turbine engine, the method comprising:

locating a first bushing at least partially surrounding a first trunnion extending from a first end of the variable vane, the first trunnion includes an outer surface having a plurality of troughs and the first bushing includes a plurality of peaks extending inward from an inner surface;

producing relative movement between the first bushing and the first trunnion to form a carbon transfer film between the first bushing and the first trunnion; and wherein a depth of each trough is substantially equal to a spacing between the first bushing and the first trunnion.

17. The method of claim 16, wherein producing relative movement between the first bushing and the first trunnion includes wearing the plurality of peaks down to the inner surface on the first bushing.

18. A method of operating a variable vane for a gas turbine engine, the method comprising:

locating a first bushing at least partially surrounding a first trunnion extending from a first end of the variable vane, the first trunnion includes an outer surface having a plurality of troughs and the first bushing includes a plurality of peaks extending inward from an inner surface;

producing relative movement between the first bushing and the first trunnion to form a carbon transfer film between the first bushing and the first trunnion;

comprising locating a second bushing at least partially surrounding a second trunnion extending from a second end of the variable vane, the second trunnion includes an outer surface having a second plurality of troughs and the second bushing includes a second plurality of peaks extending inward from an inner surface;

comprising producing relative movement between the second bushing and the second trunnion to form a carbon transfer film between the second bushing and the second trunnion; and wherein producing relative movement between the second bushing and the second trunnion includes wearing the second plurality of peaks down to the inner surface on second bushing.

19. The method of claim 18, wherein producing relative movement between the first bushing and the first trunnion includes wearing the plurality of peaks down to the inner surface on the first bushing.

20. The method of claim 18, wherein a depth of each trough is substantially equal to a spacing between the first bushing and the first trunnion.

* * * * *